US005308051A

United States Patent [19]

Spitzmesser

[11] Patent Number: 5,308,051

[45] Date of Patent: May 3, 1994

[54] DEVICE FOR FOLDING SHEETS OF PAPER

[76] Inventor: Gordon Spitzmesser, 535 Sewanee Ave., Cayce, S.C. 29033

[21] Appl. No.: 974,258

[22] Filed: Nov. 10, 1992

[51] Int. Cl.[5] ..... B31B 1/26; B31F 1/00

[52] U.S. Cl. ..... 270/45; 493/405; 493/457

[58] Field of Search ..... 493/405, 406, 451, 457; 270/32, 45

[56] References Cited

U.S. PATENT DOCUMENTS

| | | | |
|---|---|---|---|
| 196,075 | 10/1877 | Connell | 493/405 |
| 890,500 | 6/1908 | Cooper | 493/406 |
| 1,245,421 | 11/1917 | Amberg | 493/457 |
| 1,346,109 | 7/1920 | Astley | 493/405 |
| 2,918,276 | 12/1959 | Weston | 493/405 |
| 3,024,019 | 3/1962 | Ladenburger | 493/457 |
| 3,514,097 | 5/1970 | Hoff | 493/457 |
| 4,002,331 | 1/1977 | Kraft et al. | 493/406 |
| 4,421,500 | 12/1983 | Smith | 493/405 |
| 5,226,872 | 7/1993 | Watson | 493/405 X |

*Primary Examiner*—Edward K. Look
*Assistant Examiner*—John Ryznic
*Attorney, Agent, or Firm*—Michael A. Mann

[57] ABSTRACT

A device for folding sheets of paper for placement in envelopes. The device has a center planar member and two side planar members connected with hinges so that the two side members can be rotated over the center member. A laminar member with beveled edges and coextensive with the center member is attached to the center member in such a way that a sheet of paper can be inserted between them so that it extends in part beyond the center member to each side members. The user rotates each side member in turn over the center member, thereby enabling the laminar member to crease the paper. Indicator lines on one of the side members allows the alignment of the paper with respect to the laminar member so that creases are made in desired locations.

18 Claims, 1 Drawing Sheet

DEVICE FOR FOLDING SHEETS OF PAPER

BACKGROUND OF THE INVENTION

1. Field of the Invention

The present invention relates to folding sheets of stationery or other papers. In particular, the present invention relates to a device for evenly folding sheets of paper to fit into envelopes.

2. Discussion of Background

Sheets of paper are available in many different sizes, including the familiar 8.5"×11" (about 21.6×27.9 cm), 8.5"×14" (about 21.6×35.6 cm), and A4 metric (21×30 cm; about 8.3"×11.8") standard sizes. Envelopes are also available in different sizes. Some envelopes are dimensioned to accept standard size paper without folding; most envelopes, however, require folding the paper approximately into halves, thirds, or fourths for insertion therein. A commonly-used envelope is dimensioned to accept standard letter-size paper folded into thirds. By "folded into thirds" it is meant that the paper has two creases running parallel to the shorter side and dividing the sheet into three, roughly equal sections.

Paper is preferably folded so that the creases are sharp, parallel to the sides of the paper and spaced so that the folded paper just fits into the chosen envelope. Folding paper by hand does not always result in sufficient precision; the creases may not be parallel to the sides and one section of the folded paper may be too large, perhaps too large to fit into its envelope. Accordingly, envelopes for business use have a little margin to accommodate a slightly misfolded sheet.

Applicant is unaware of devices for folding sheets of stationery into evenly-spaced divisions for placement in envelopes.

SUMMARY OF THE INVENTION

According to its major aspects and broadly stated, the present invention is a device for folding paper for placement in envelopes. The device has a center member and two side members connected to the center member with hinges so that the side members can be rotated about axes of rotation over the center member. A laminar member is attached to the center member so that a sheet of paper can be inserted between them and extend beyond the laminar member to the two side members, the sheet's long side perpendicular to the axes of rotation of the side members. The laminar member has beveled edges and is coextensive with the center member so that the beveled edges are just off the axis of rotation of the side members. When a sheet of paper is inserted in the device and the side members are rotated, the laminar member, in cooperation with the side and center members, makes creases in the paper perpendicular to a long side of the sheet of paper.

The overall dimension of the device is selected for folding a standard stationery size, such as 8½ by 11. One or both of the side members carries indicator lines to align the sheet so that the creases are in the desired location. The outer edges of the side members have finger recesses to facilitate rotation.

The cooperation of the three members is an important feature of the present invention. When one of the side members is rotated over the center member, its top face will be facing the laminar member's beveled edge and the bottom, flat face of the laminar member will be facing the top face of the center member. A sheet of paper inserted in the device will be creased by the laminar member's beveled edge against the side and center members.

Another feature of the present invention is the dimensions and tolerances of the device. The creases are sharper and more accurately made because the edges of the planar member are sharply beveled and are just off the axes of rotation of the side members. Furthermore, since the device has overall dimensions of a standard sheet of stationery, a sheet of standard stationery will just fit on the device and can be quickly centered by the fingers of the user. Once the stationery is centered, the device will crease it in the appropriate location. Indicator lines carried by the side members enable different sizes of stationery to be folded accurately.

Another feature of the invention is the hinges. These are preferably made of plastic and attached to the members by bolts and nuts so that forces on the screws or bolts holding the hinges in place are perpendicular to the axes of the bolts. The hinges are recessed in the top faces of the three members so that they do not interfere with the positioning or removal of the sheets.

An additional feature of the present invention is the finger recesses to facilitate rotation of the side members.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 2:
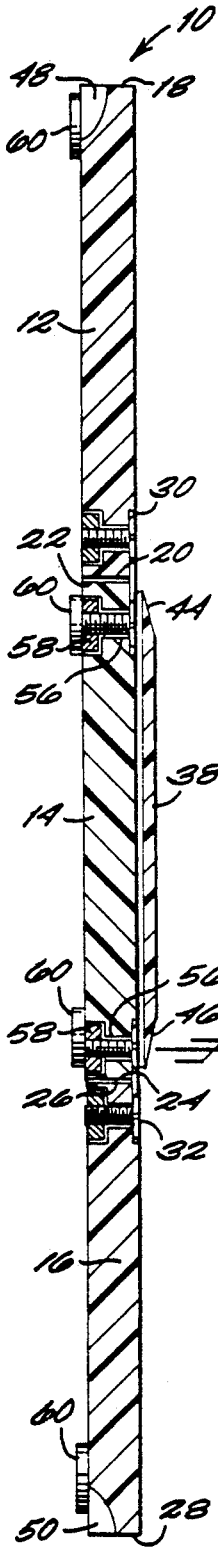
FIG. 2 is a cross-sectional view of the device of FIG. 1 along the line 2—2.
Figure 1:
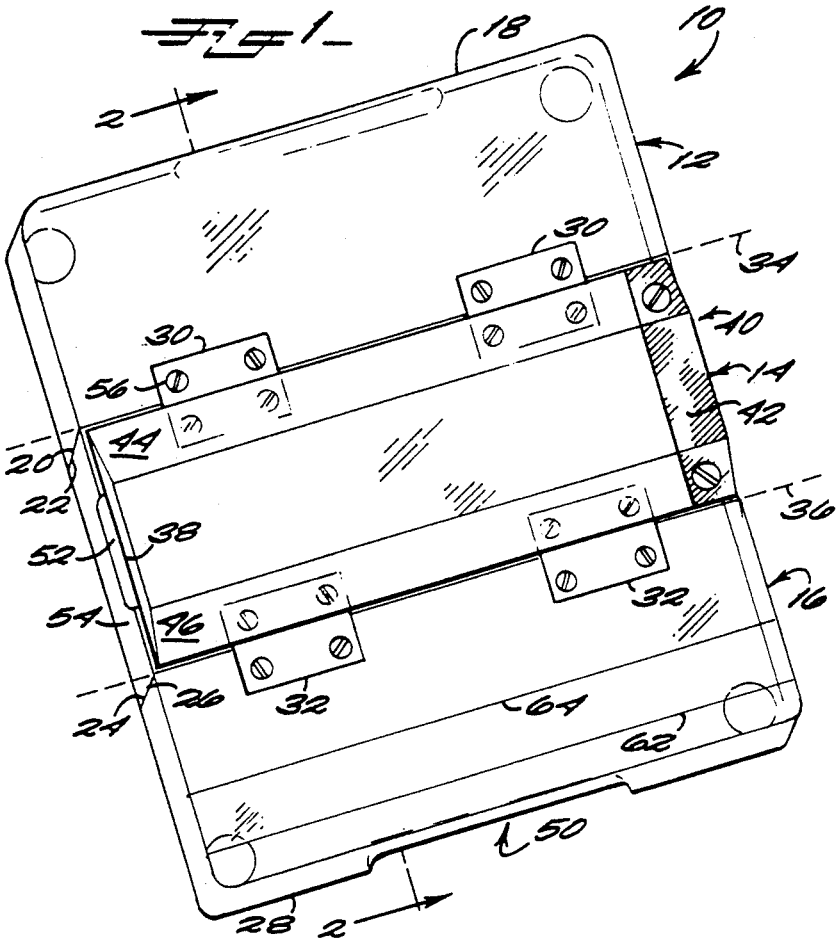
FIG. 1 is a perspective view of a device according to a preferred embodiment of the present invention.

Referring now to FIGS. 1 and 2, there is shown a perspective view and a side view of a device for folding sheets of paper according to the present invention. Device 10 has three, adjacent planar members: a first side member 12, a center member 14, and a second side member 16. First side member has a first edge 18 and a second edge 20; center member has a first edge 22 and a second edge 24; and second side member 16 has a first edge 26 and a second edge 28.

Second edge 20 of first side member 12 is joined to first edge of center member 14 by hinges 30; first edge 26 of second side member 16 is joined to second edge 24 of center member 14 by hinges 32.

Hinges 30 and 32 enable first side member 12 and second side member 16 to rotate about axes 34 and 36, respectively, with respect to center member 14.

Center member 14 has a laminar member 38 attached to it along a first side 40 and spaced just above center member 14 by a stop 42. Laminar member 38 has a first beveled edge 44 and a second beveled edge 46 and is co-extensive with center member 14; that is, laminar member 38 and center member 14 are substantially the same width so that beveled edges 44, 46 are just off axes 34, 36.

First edge 22 of first side member 12 and second edge 28 of second side member 16 each have a finger recess 48, 50, respectively, to facilitate rotation of first and second side members 12, 16 about axes 34, 36. Center member 14 has a finger recess 52 in a second side 54, opposing first side 40, to facilitate lifting the free end of laminar member 38.

Hinges 30, 32, laminar member 38 and stop 42 are preferably attached to first side member 12, second side member 16 and center member 14 using bolts 56 and nuts 58 rather than screws. Using screws requires drilling holes and tapping them with threads; bolts require only the drilling of holes. Hinges 30, 32 are preferably recessed and made of plastic rather than interconnected metal leaves so that the faces of first side member 12, center member 14, and second side member 16 are as smooth as possible.

Under device are preferably a plurality of pads 60 to prevent slippage of device when in use and to prevent scratching of the surface on which it is used. Rubber strips or other cushioning, non-slip material are equally suitable.

Device 10 is made of any convenient materials. The materials for device 10 may be chosen both for their functional aspects and for an esthetically pleasing effect. Thus, planar members 12, 14, 16, and laminar member 38 may be fashioned of glass, wood, metal, plastics such as PLEXIGLAS or TEFLON, or combinations thereof. Stop 42 is made of any suitable material, including glass, wood, metal, or plastic.

Device 10 and its various components are dimensioned to accommodate standard size paper such as 8.5"×11.0" (about 21.6 cm×27.9 cm) letter paper and to make creases in the preselected locations on such paper. Members 12, 14, 16 are rectangular and the same size, preferably with rounded corners. The length of device 10 is substantially equal to the length of a standard sheet of paper. For use with other sizes of paper, indicator lines 62, 64 can be used. Line 62 is used for making the first fold in a sheet of legal size paper; line 64 can be used for A4 international. Other lines can be added for other sizes of paper.

Device 10 is used to make two spaced-apart folds in a sheet of letter paper, so as to prepare the paper for placement in a standard size envelope. Typically, envelopes are sized to accept standard size letter paper folded into thirds. With side members 12, 16 laying flat and substantially coplanar with center member 14, the user slides a sheet of paper between laminar member 38 and center member 14. The user adjusts the paper so that a first portion of the sheet is between laminar member 38 and center member 14, one side edge of the paper against stop 42 and the remaining portions extending beyond the laminar and center members so that one side of the paper is aligned with first edge 18 of first side member 12 and the other side is aligned with second edge 28 of second side member 16. The user rotates first side member 12 and then second side member 16 over center member 14 about their respective axes of rotation, 34, 36, creasing the paper along beveled edges 44, 46, respectively. After making the creases and returning first side and second side members 12, 16 to their resting, coplanar positions, the user removes the sheet of paper from device 10 for placement in a standard envelope. For ease of use, device 10 has no "handedness;" that is, the order in which first side and second side members 12, 16 are rotated does not matter.

Figure 3:
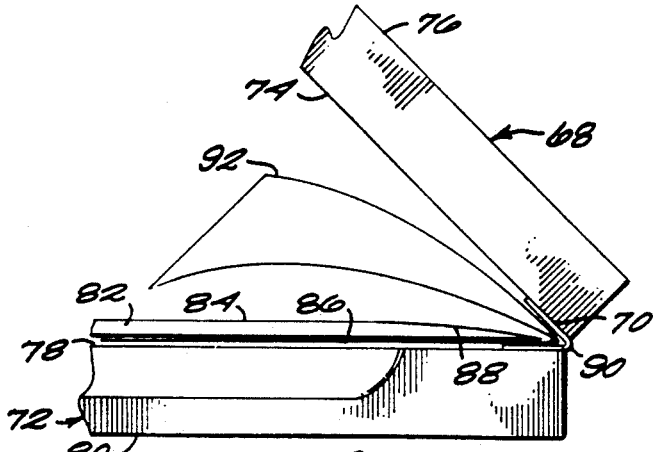
FIG. 3 is a detailed end view of a device according to a preferred embodiment of the present invention showing a piece of paper being creased.

A detail of the creasing process in shown in FIG. 3. There, a first member 68 is attached by a hinge 70 to a second member 72. First member 68 has a first face 74 and a second face 76; second member 72 has a first face 78 and a second face 80. A laminar member 82 is attached to second member 72 and has a top face 84, a flat bottom face 86 and an angled face 88. Since bottom face 86 is not parallel to angled face 88, they meet to form a beveled edge 90 just off the axis of rotation enabling more complete rotation of first member 68 and, more importantly, providing a sharp edge against which a sheet of paper 92 is pressed. "Just off" means beveled edge 90 is within a few sheets of paper thickness from the axis of rotation. The closer first face 74 of first member 68 is to angled face 88 of laminar member 82, first face 78 of second member 72, and bottom face 86 of laminar member 82, the sharper the crease in paper 92, but the fewer sheets of paper can be folded at the same time. Preferably, the device can fold five sheets at once so beveled edge 90 should be just off axis of rotation by the thickness of five sheets of standard weight paper or not more than about 1/16th inch. Laminar member 82 should be separated from second member 72 by approximately 1/16" (about 1.6 mm) for acceptance of as many as five standard sheets of paper.

A device according to the present invention can be used to fold materials such as thin cardboard and metal foil as well as sheets of letter paper. As will be evident, a device according to the present invention has at least two planar members, and may have four or more planar members depending on the number of creases to be made in the paper. Furthermore, a device may be formed of a single sheet of flexible polymer material, with an integral laminar member and scores along the desired crease lines in place of hinges. However, using more durable materials, materials that are dimensionally stable over long periods of use, will provide better service. Furthermore, using better materials will enable manufacturing of a more precise instrument.

It will be apparent to those skilled in the art that many changes and substitutions can be made to the preferred embodiment herein described without departing from the spirit and scope of the present invention as defined by the appended claims.

What is claimed is:

1. A device for folding sheets of paper, said device comprising:

a first member;

a second member;

hinge means for attaching said first member to said second member so that said first member can rotate about an axis with respect to said second member;

a laminar member having an edge, said laminar member attached to said first member so that said edge is just off said axis, said laminar member carried by said first member so that said sheet of paper can be placed between said laminar member and said first member with a portion of said paper extending beyond said first member to said second member, said laminar member creasing said sheet of paper when said second member is rotated about said axis with respect to said first member.

2. The device as recited in claim 1, wherein said hinge means further comprises at least two hinges.

3. The device as recited in claim 1, wherein said edge is beveled.

4. The device as recited in claim 1, wherein said first member has a first face and said second member has a second face, and wherein said laminar member has an angled face and an opposing, non-parallel, flat face that together define a beveled edge, said flat face facing said first face of said first member, said second member facing said angled face when said second member is rotated about said axis.

5. The device as recited in claim 1, wherein said sheet of paper is to be creased at a preselected location and said device further comprises means for aligning said sheet of paper so that said creasing means ceases said sheet of paper at said preselected location.

6. The device as recited in claim 1, wherein said sheet of paper may be creased at more than one preselected location and said device further comprises means for aligning said sheet of paper so that said laminar member can crease said sheet of paper at any of said preselected locations.

7. The device as recited in claim 1, wherein said sheet of paper has at least one straight side and said device further comprises means for aligning said sheet of paper so that said laminar member makes a crease in said sheet of paper perpendicular to said straight side.

8. A device for folding a sheet of paper, said device comprising:

a first side member having a first edge;

a center member having a first edge and an opposing second edge;

first hinge means for attaching said first edge of said first side member to said first edge of said center member, said first hinge means enabling rotation of said first side member with respect to said center member about a first axis;

a second side member having a first edge;

second hinge means for attaching said first edge of said second side member to said second edge of said center member, said second hinge means enabling rotation of said second side member with respect to said center member about a second axis; and a laminar member dimensioned to cover said center member and having a first edge adjacent to said first edge of said center member and a second edge adjacent to said second edge of said center member, said laminar member attached to said center member so that said sheet of paper can be placed between said center member and said laminar member, a first portion of said paper extending beyond said center member to said first side member and a second portion of said sheet of paper extending beyond said center member to said second side member, said laminar member making two spaced-apart creases in said sheet of paper when said first and second side members are rotated about said first and second axes respectively.

9. The device as recited in claim 8, wherein said first and said second edge of said laminar member are beveled.

10. The device as recited in claim 8, wherein said first side member has a first face and said center member has a second face, and wherein laminar member has an angled face and an opposing, non-parallel, flat face that together define a beveled edge, said flat face facing said first face of said first member, said laminar member attached to said first member so that said edge is just off said first axis, said second member facing said angled face when said second member is rotated about said first axis.

11. The device as recited in claim 8, wherein said first side member has a first face, said center member has a second face and said second side member has a third face, and wherein said laminar member has a first angled face and an opposing, non-parallel, first flat face that together define a beveled first edge, said laminar member having a second angled face and an opposing, non-parallel, second flat face that together define a beveled second edge, said first flat face facing said second face of said center member, said second flat face facing said second face of said center member, said laminar member attached to said first member so that said first beveled edge is just off said first axis and said second beveled edge is just off said second axis, said first side member facing said first angled face when said first side member is rotated about said first axis and said second side member facing said second angled face when said second side member is rotated about said second axis.

12. The device as recited in claim 8, wherein said sheet of paper is to be creased at two preselected locations and said device further comprises means for aligning said sheet of paper so that said laminar member creases said sheet of paper at said preselected locations.

13. The device as recited in claim 8, wherein said device is for use with different sizes of sheets of paper wherein each size of paper has a corresponding set of crease locations, said device further comprising means for aligning said sheet of paper so that said laminar member can crease said different sizes of sheets of paper at its set of crease locations

14. The device as recited in claim 8, wherein said sheet of paper has at least one straight side and said device further comprises means for aligning said sheet of paper so that said laminar member makes creases in said sheet of paper perpendicular to said straight side.

15. The device as recited in claim 8, further comprising at least one indicator line carried by said first side member for aligning said sheet of paper so that said laminar member makes creases in desired locations on said sheet of paper.

16. The device as recited in claim 8, wherein said device has a rear surface, and said device further comprises cushions carried by said rear surface.

17. A device for folding a sheet of paper, said device comprising:

a first side member having a first edge;

a center member having a first edge and an opposing second edge;

at least one first hinge joining said first edge of said first side member to said first edge of said center member so that said first side member can rotate about a first axis with respect to said center member;

a second side member having a first edge;

at least one second hinge joining said first edge of said second side member of said second edge of said center member so that said second side member can rotate about a second axis with respect to said center member; and a laminar member attached to said center member and having a first beveled edge and a second beveled edge and being coextensive with said center member so that said first beveled edge is just off said first axis and said second beveled edge is just off said second axis, said laminar member carried by said center member so that said sheet of paper can be placed between said laminar member and said center member, a first portion of said paper extending beyond said center member to said first side member and a second portion of said sheet of paper extending beyond said center member to said second side member, said laminar member making two spaced-apart creases in said sheet of paper when said first and second side members are rotated about said first and second axes respectively.

18. The device as recited in claim 17, further comprising indicator lines carried by said first side for aligning said sheet of paper with respect to said laminar member so that creases are made in preselected locations on said sheet of paper.

* * * * *